US006709533B2

(12) United States Patent
Honkura et al.

(10) Patent No.: US 6,709,533 B2
(45) Date of Patent: Mar. 23, 2004

(54) MANUFACTURING METHOD OF AN ANISOTROPIC MAGNET POWDER, PRECURSORY ANISOTROPIC MAGNET POWDER AND BONDED MAGNET

(75) Inventors: Yoshinobu Honkura, Tokai (JP); Norihiko Hamada, Tokai (JP); Chisato Mishima, Tokai (JP)

(73) Assignee: Aichi Steel Corporation, Tokai (JP)

( * ) Notice: Subject to any disclaimer, the term of this patent is extended or adjusted under 35 U.S.C. 154(b) by 0 days.

(21) Appl. No.: 09/955,078

(22) Filed: Sep. 19, 2001

(65) Prior Publication Data

US 2002/0059965 A1 May 23, 2002

(30) Foreign Application Priority Data

Sep. 20, 2000 (JP) ..... 2000-285679

(51) Int. Cl.[7] ..... H01F 1/057
(52) U.S. Cl. ..... 148/105; 148/122
(58) Field of Search ..... 148/101, 105, 148/122

(56) References Cited

U.S. PATENT DOCUMENTS

| | | | | |
|---|---|---|---|---|
| 4,663,066 A | * | 5/1987 | Fruchart et al. | 148/302 |
| 5,091,020 A | * | 2/1992 | Kim | 148/101 |
| 5,110,374 A | * | 5/1992 | Takeshita et al. | 148/101 |

FOREIGN PATENT DOCUMENTS

| | | |
|---|---|---|
| JP | 05 179313 | 7/1993 |
| JP | 05-209210 | 8/1993 |
| JP | 06-120015 | 4/1994 |
| JP | 07-078710 | 3/1995 |
| JP | 07-245206 | 9/1995 |
| JP | 09 115711 | 5/1997 |
| JP | 9-165601 | 6/1997 |
| JP | 10-326705 | 12/1998 |
| JP | 2000-96102 | 4/2000 |
| JP | 2000 096102 | 4/2000 |
| JP | 2001-76917 | 3/2001 |
| WO | WO 00/19456 | 4/2000 |

OTHER PUBLICATIONS

Patent Abstracts of Japan, JP 09–115711, May 2, 1997.
Patent Abstracts of Japan, JP 05–179313, Jul. 20, 1993.
Patent Abstracts of Japan, JP 2000–096102, Apr. 4, 2000.
C. Mishima, et al., IEEE Transactions on Magnetics, vol. 37, No. 4, pp. 2467–2470, "Development of a Co–Free NdFeB Anisotropic Bonded Magnet Produced from the D–HDDR Processes Powder", Jul. 2001.
Abstracts of the Japan Institute of Metals, p. 422, Oct. 1, 2000, With Partial English Translation.
I. Mishima, et al., Journal of the Magnetics Society of Japan, vol. 24, No. 4–2, pp. 407–410, "Dependence of the Hydrogen Pressure on the Magnetic Properties of NdFeB Anisotropic Magnet Powders Produced by the HDDR Method", 2000 (with English Abstract).

(List continued on next page.)

*Primary Examiner*—John Sheehan
(74) *Attorney, Agent, or Firm*—Oblon, Spivak, McClelland, Maier & Neustadt, P.C.

(57) ABSTRACT

This invention aims to provide a manufacturing method of an anisotropic magnet powder from which a bonded magnet with an improved loss of magnetization due to structural changes can be achieved. This is achieved by employing a low-temperature hydrogenation process, high-temperature hydrogenation process and the first evacuation process to an RFeB material (R: rare earth element) to manufacture a hydride powder (RFeBHx); the obtained RFeBHx powder (the precursory anisotropic magnet powder) is subsequently blended with a diffusion powder composed of hydride of dysprosium or the like and a diffusion heat-treatment process and a dehydrogenation process are employed. Through this series of processes, an anisotropic magnet powder with a great coercivity and a great degree of anisotropy can be achieved.

13 Claims, 3 Drawing Sheets

OTHER PUBLICATIONS

T. Ikegami, et al., Journal of the Japan Society of Powder and Powder Metallurgy, vol. 44, No. 9, pp. 818–821, "Improvement of Intrinsic Coercivity in HDDR–Processed Anistropic Permanent Magnets", Sep. 1997 (with English Synopsis).

N. Hamada, et al., Proceedings of the Sixteen International Workshop on Rare–Earth Magnets and Their Applications, pp. 813–819, "Enhancement of Heat Resistance of Nd–Fe–B Anisotropic Magnet by DY Addition in HDDR Process", Sep. 2000.

Y. Itou, et al., Journal of the Japan Institute of Metals, vol. 59, No. 1, pp. 103–107, "Effects of DY Compound Powder Addition on the Microstructures and the Magnetic Properties of Nd–Fe–B Sintered Magnets", 1995.

Digests of the $22^{nd}$ Annual Conference on Magnetics in Japan, p. 110, Sep. 20–23, 1998, With Partial English Translation.

S.Hirosawa, et al., Journal of Applied Physics, vol. 81, No. 8, pp. 4821–4826, New Aspects of Nd–Fe–B–Based Hydrogenation–Disproportionation–Descorption–Recombination Powders and Anistropic Bonded Magnets Made Form Them: Microstructure and Magnetic Properties (Invited), Apr. 15, 1997.

K. Morimoto, et al., IEEE Tranactions on Magnetics, vol. 35, No. 5, pp. 3253–3255, "Anistropic $Nd_2Fe_{14}B$–Based Magnet Powder with High Remanence Produced by Modified HDDR Process", Sep. 1999.

K. Ohashi, et al., Journal of the Magnetics Society of Japan, vol. 11, No. 2, pp. 235–238, "Effects of Rare Earth Oxide Addition on NdFeB Magnets", 1987 (with English Abstract).

T. Ikegami, et al., Proceeding of the $9^{th}$ Intern. Symp. Magnetic Anistropy and Coercivity in Rare–Earth Transition Met. Alloys, vol. 2, pp. 288–296, "High–Coercivity Anistropic HDDR Powder Containing Heavy Rare Earths", 1996.

V. Panchanathan et al.; "Properties of Bonded Anistropic Magnets"; 931 Journal of Applied Physics; 70(1991) Nov. 15, No. 10, Pt. II, New York, US; pp. 6465–6467.

X. Fang et al.; "Modeling of Magnetic Properties of Heat Treated Dy–Doped NdFeB Particles Bonded in Isotropic and Anistropic Arrangements"; IEEE Transactions on Magnetics, vol. 34, No. 4; Jul. 1998; pp. 1291–1293.

* cited by examiner

Composition: 1.0 mol% Dy
Measured grain size: 75/106 μ m

Temperature: 1073 K
Time: 3.6 ks

MANUFACTURING METHOD OF AN ANISOTROPIC MAGNET POWDER, PRECURSORY ANISOTROPIC MAGNET POWDER AND BONDED MAGNET

BACKGROUND OF THE INVENTION

1. An Technical Field Affiliated with the Invention

The present invention concerns the manufacturing methods of an anisotropic magnet powder, the precursory anisotropic magnet powder and it manufacturing method, as well as a bonded magnet made from this powder.

2. The Conventional Technique

Magnets are widely used in many of the machines in our surroundings, including various types of motors. There is a need for a stronger permanent magnet in order to reduce the weight, thickness and length of an the increase efficiency of these machines. A rare earth element magnet (RFeB magnet) mainly composed of $Nd_2Fe_{14}B$ has been attracting much attention as a candidate for such a permanent magnet, and its range of applications has been expanded greatly. For example, it is being considered as a motor magnet in various types of machines in the automobile engine room. Here it is desired that the magnet have a high heat resistance because the temperature inside the engine room exceeds 100° C.

However, the precursory anisotropic magnet powder (RFeB magnetic powder) has large temperature dependence (temperature coefficient), which causes a poor heat-resistance. The coercivity decreases rapidly at the high range of temperatures. It has been difficult to readily improve the temperature dependency so far. A remedy for this may be the use of an anisotropic magnet powder which originally has a very large coercive force (iHc), so that the magnet may keep a large enough coercive force even at the high range of temperatures. Such an anisotropic magnet powder and its manufacturing methods have been disclosed in Japanese laid-open patent numbers 9-165601 and 2000-96102.

Concretely, in Japanese laid-open patent number 9-165601, a manufacturing method of an anisotropic magnet powder by HDDR (hydrogenation—decomposition—desorption—recombination) method has been shown using an ingot to which a minute amount of Dy was added to the molten RfeB alloy, resulting in an average crystal radius ranging from 0.05–1 $\mu$m.

However, when the inventors actually tried to manufacture this anisotropic magnet powder, a stable coercivity could not be achieved due to the limited amount of Dy additive and the method was also difficult to mass-produce. In addition, the coercivity of the anisotropic magnet powder produced by this method was at most 16 kOe (1272 kA/m).

In general, a desirable anisotropic magnet powder should have large values for both coercivity (iHC) and degree of anisotropy (Br/Bs), where (Br) is the residual magnetic flux density and (Bs) is the saturation magnetic flux density. However, while the addition of Dy is efficient for improving the coercivity, it will also reduce the rate of HDDR reaction causing a decline in the degree of anisotropy. For these reasons, until now, these values have not been optimized at the same time.

In Japanese laid-open patent number 2000-96102, another manufacturing method of an anisotropic magnet powder is described in which and a Dy alloy powder is mixed with an already produced anisotropic magnet powder, and this mixture is heat treated under a vacuum or inactive gas atmosphere so that the anisotropic magnet powder receives a thin coating of Dy on its surface. In this way, an appropriate amount of Dy can be coated on the powder surface, increasing the coercivity to as high as 18 kOe (1432 kA/m) and maintaining a high degree of anisotropy.

However, because the starting material in this method is an anisotropic magnet powder such as $Nd_2Fe_{14}B$, the control of oxidization is difficult while Dy coating, there is substantial variation in the end powder's performance and quality. Thus a magnet made from this anisotropic magnet powder an uncontrollable loss of magnetization due to structure change, as will be discussed later, and a permanent magnet with stable heat-resistance could not be obtained.

SUMMARY OF THE INVENTION

1. A Problem to Solve in the Invention

The invention is proposed in light of the circumstances stated above, and intends to provide a manufacturing method of an anisotropic magnet powder by which a magnet with an improved coercivity and loss of magnetization due to structure change can be obtained with a high productivity and a constant quality.

The invention is also intended to provide a suitable precursory anisotropic magnet powder and to provide its manufacturing method, as well as to provide a bonded magnet with a high degree of permanent demagnetization.

2. A Means to Resolve the Problem (1) The inventors devoted themselves to the resolution of the problem, making a systematic study on it with repeated trial and error, and finally found out that oxidation is inhibited if diffusion heat-treatment is carried out after blending a RFeB hydride powder material with R1 element diffusion powder containing Dy, while the process results in an anisotropic magnet powder in which Dy is uniformly diffused on the surface of and inside the powder. That is how the inventors came to develop the present invention of a manufacturing method of anisotropic magnet powder.

The manufacturing method of the present invention comprises the following processes;

- A blending process of RFeB hydride (RFeBHx) powder, which is mainly composed of rare earth elements including yttrium (Y) (hereafter referred to as "R"), boron (B) and iron (Fe), with diffusion powder, which is composed of a simple substance, an alloy, a compound or a hydride of one or more elements in an elemental group which includes dysprosium (Dy), terbium (Tb), neodymium (Nd) and praseodymium (Pr) [hereafter referred to as "R1 elements"];
- a diffusion heat-treatment process in which R1 elements are diffused uniformly on the surface and the inside of the RFeBHx powder; and
- a dehydrogenation process (the second evacuation process) in which hydrogen is removed from the mixture of the powder after the diffusion heat-treatment process.

When RFeBHx powder and diffusion powder are mixed together in a blending process, R and Fe are difficult to oxidize compared to a conventional RFeB powder because the RFeBHx powder contains hydrogen. For this reason, in the following diffusion heat-treatment process, the diffusion of Dy, Tb, Nd and Pr (R1 elements) will diffuse into the surface and the inside of the RFeBHx powder with oxidization being sufficiently inhibited.

Furthermore, the speed of diffusion of R1 elements into the surface and the inside of the RFeBHx powder is enhanced by diffusion into the crystal particle boundaries and into the crystal particles, leading to uniform addition of R1 elements.

An anisotropic magnet powder with a large coercivity and a consistent quality can be achieved with RFeBHx powder material that can hardly be oxidized, and diffusion of R1 elements with inhibited oxidization. A bonded magnet molded from the anisotropic magnet powder obtained by this method will have an improved loss of magnetization due to structure change. This loss of magnetization is calculated using the magnetic flux when the sample magnet is initially put in a magnetic field and the magnetic flux after the sample is left under air atmosphere for 1000 hours at 120° C., where the magnet does not recover when remagnetized. And the loss of magnetization is a comparison to the initial magnetic flux.

Furthermore, the inventors of the present invention developed a suitable RFeBHx powder, or precursory anisotropic magnet powder, for manufacturing of such an anisotropic magnet powder. The precursory anisotropic magnet powder is the RFeB hydride (RFeBHx) powder which is mainly composed of rare earth elements including yttrium (Y), boron (B) and iron (Fe) and is characterized by an average crystal radius ranging from 0.1–1.0 $\mu$m.

The use of the RFeBHx powder, or precursory anisotropic magnet powder, makes it easier to manufacture, for example, the anisotropic magnet powder stated above.

The reasons that the range of 0.1–1.0 $\mu$m was chosen as the average crystal radius is the difficulty to manufacture RFeBHx powder whose average crystal radius is less than 0.1 $\mu$m, and the poor coercivity of anisotropic magnet powder made from RFeBHx powder whose average crystal radius is greater than 1.0 $\mu$m.

The average crystal radius was determined via TEM (transmission electron microscope). Crystal particles of RFeBHx powder were observed, two-dimensional image processing was carried out, equivalent cross sections of the area circles and crystal particles were assumed and the average radius was calculated.

For the precursory anisotropic magnet powder and the anisotropic magnet powder described above, there are no particular restrictions to the particle shape or size, so both fine and coarse powders are available. When the RFeB material is in a powder state, it is not necessary to establish an additional crushing process, however if a crushing process is carried out, anisotropic magnet powder or precursory anitsotropic magnet powder with a narrow distribution of particle radius can be obtained.

In addition, by using the anisotropic magnet powder mentioned above, a bonded magnet with an improved loss of magnetization due to structure change was invented. A bonded magnet is mainly composed of rare earth elements including yttrium (Y), boron (B) and iron (Fe), made of an anisotropic magnet powder whose average crystal radius is 0.1–1.0 $\mu$m, was developed with a degree of anisotropy (Br/Bs) (the ratio of the residual magnetic flux density (Br) to the saturation magnetic flux density (Bs)) greater than 0.75, and a loss of magnetization less than 15% due to structural changes.

Because the bonded magnet is made of an anisotropic magnet powder whose crystal particle is small with a high degree of anisotropy, the bonded magnet not only has greater magnetic characteristics, but also has improved heat-resistance for its low loss of magnetization due to structural changes, which is less than 15%.

A bonded magnet with a loss of magnetization due to structure changes greater than 15% will have poor heat-resistance that is unsuitable for long-term use under high-temperature conditions. The degree of anisotropy, which is given by the ratio of Br to Bs, depends on the composition (volume %) of an anisotropic magnet powder. For example, when the anisotropic magnet powder consists of only $Nd_2Fe_{14}B$, an appropriate Bs is 1.6 T, while with the addition of Dy, Bs is reduced to 1.4 T due to ferromagnetism.

The present invention consists not only of an RFeBHx powder, but also consists of the manufacturing method of the precursory anisotropic magnet powder.

The manufacturing method of the present invention comprises the following processes;

A low-temperature hydrogenation process in which a RFeB powder, which is mainly composed of rare earth elements including yttrium (Y), boron (B) and iron (Fe), is maintained under hydrogen gas atmosphere at a temperature lower than 600° C.;

a high-temperature hydrogenation process in which the powder is maintained under hydrogen gas atmosphere with pressure ranging from 0.1–0.6 MPa and temperature ranging from 750–850° C.; and the first evacuation process in which the powder is maintained under hydrogen gas atmosphere with pressure ranging from 0.1–0.6 kPa and temperature ranging from 750–850° C.

Following each process (low-temperature hydrogenation, high-temperature hydrogenation and the first evacuation process) controlled under the proper conditions, a structure transformation in the RFeB material will occur, bringing about homogenized minute crystal particles and RFeBHx powder with a high degree of anisotropy.

DETAILED DESCRIPTION OF THE PREFERRED EMBODIMENT

Applied Forms of the Invention

Figure 1:
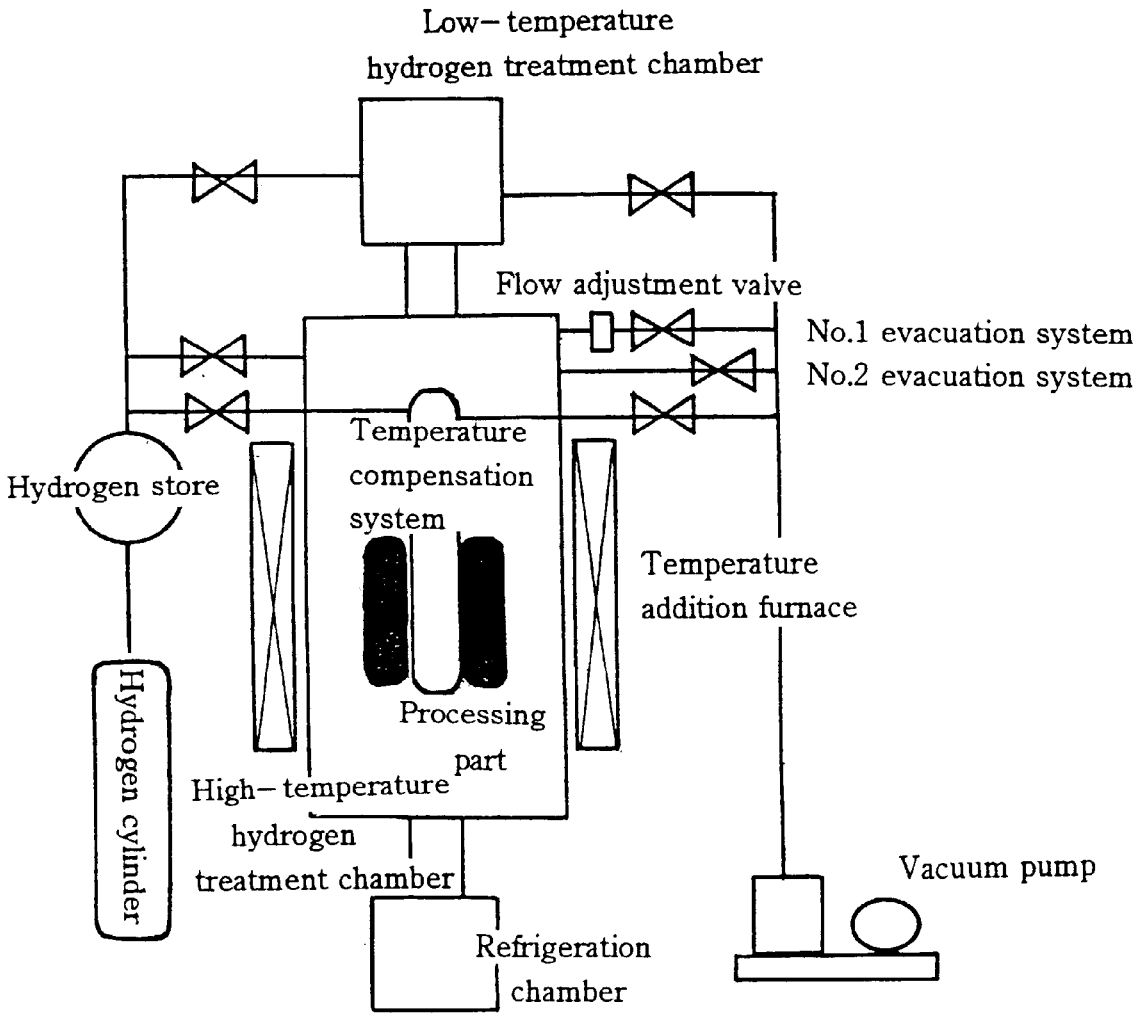
FIG. 1 Hydrogenation-treatment furnace that was used for the manufacturing of the precursory anisotropic magnet powder is schematically displayed.

Detailed explanations of the present invention will be given illustrating the applied forms of the present invention as follows.

(1) RFeB Material

The RFeB material is mainly composed of rare earth elements (R) including Y, B and F. More concretely, the RFeB material is an ingot whose main phase is $R_2Fe_{14}B$.

The rare earth element R, including Y, is not limited to be one type of element. It may be a combination of a number of rare earth elements, or one part of the main element may be replaced by other elements.

Lanthanum (La), cerium (Ce), praseodymium (Pr), neodymium (Nd), samarium (Sm), gadolinium (Gd), terbium (Tb), dysprosium (Dy), holmium (Ho), erbium (Er), thulium (a TM element) and lutetium (Lu) are all possible elements for R other than Y. The use of more than one of them is favorable.

The choice of neodymium (Nd) for R is especially desirable, yielding NdFeB material, for example $Nd_2Fe_{14}B$, which has great magnetic characteristics. Furthermore, there is a stable supply of this material.

The desired RFeB material should be mainly composed of iron, including 11–15 at % of R and 5.5–8 at % of B.

With less than 11 at % of R content, a α Fe phase will be deposited, causing a decline in magnetic characteristics, while with greater than 15 at % of R content, the $R_2Fe_{14}B$ phase will decrease, also causing a decline in magnetic characteristics. On the other hand, with less than 5.5 at % of B content, soft magnetic $R_2Fe_{17}$ phase will be deposited causing a decline in magnetic characteristics, while with more than 8 at % of B content, $R_2Fe_{14}B$ phase will decrease, causing a decline in magnetic characteristics.

It is also desirable that either gallium (Ga) or niobium (Nb) is included in the RFeB material. Furthermore, a compound addition of both is even more desirable.

Ga is an efficient element for improvement of the coercivity (iHC) of an anisotropic magnet powder. Between 0.01–2 at % of Ga content is desirable because less than 0.01 at % of Ga content does not bring about sufficient improvement in coercivity, while more than 2 at % of Ga content causes a decline in coercivity.

Nb is an efficient element for improvement of the residual magnetic flux density (Br). Between 0.01–1 at % of Nb content is desirable because less than 0.01 at % of Nb content does not bring about sufficient improvement in residual magnetic flux density (Br), while more than 1 at % of Nb content slows the hydrogenation reaction in the high-temperature hydrogenation process. A compound addition of Ga and Nb brings about an improvement in both coercivity and degree of anisotropy, leading to an increase in the maximum energy product, or (BH)max. The RFeB material may also contain Co.

Co is an efficient element for improvement of the Curie temperature of an anisotropic magnet powder; it becomes especially desirable with Co content less than 20 at %.

Other than Co, the RFeB material may contain one, or more than one, of Ti, V, Zr, Ni, Cu, Al, Si, Cr, Mn, Mo, Hf, W, Ta and Sn. A magnet made of anisotropic magnet powder containing these elements will have an improved coercivity and squareness of the demagnetization curve. It is favorable to keep the content of these elements to less than 3 at % because with the increased content of these elements, a deposited phase will appear, causing a decline in coercivity.

Ingot melted by various methods (high frequency melting method, nuclear melting method and so on), cast ingot or strips manufactured by a strip-casting method are possible examples of a RFeB material. In this case, it is desirable if the ingots or strips are crushed into a coarse or fine powder because HDDR treatment will then occur homogeneously. For the crushing process, it is possible to use either general hydrogen crushing or mechanical crushing.

(2) RFeBHx Powder

RFeBHx powder is a hydride powder of the abovementioned RFeB material. The hydride (RFeBHx) here means not only the case where hydrogen is chemically combined, but also the case where hydrogen is in a solid solution state. The RFeBHx powder can be obtained by, for example, using the abovementioned manufacturing processes that includes low-temperature hydrogenation, high-temperature hydrogenation and the first evacuation process.

RFeB material can be used in a powder state, and it is possible to add crushing and powdering processes at a suitable time during or after manufacturing of the hydride (RFeBHx). Furthermore, a powdering process can be combined with the blending process, as will be mentioned below. Explanation about the present invention of a manufacturing method of the precursory anisotropic magnet powder (RFeBHx powder) will be presented below.

① Low-temperature hydrogenation process

In the low-temperature hydrogenation process hydrogen is absorbed into the RFeB material, while the material is maintained under hydrogen gas atmosphere at a temperature lower than 600° C. Because of the hydrogen absorption into the RfeB material that occurs in this low-temperature hydrogenation process, it easier to control the rate of the order structure transformation reaction in the following high-temperature hydrogenation process.

The temperature of atmospheric hydrogen gas was set to be lower than 600° C. because temperatures higher than 600° C. will induce a structure transformation in the RFeB material, causing inhomogeneity in its structure, which is not favorable.

Although there are no particular restrictions on the pressure range for the atmospheric hydrogen gas, a range around 0.1 MPa may be desirable for economic reasons and also in terms of equipment.

An atmospheric hydrogen gas pressure ranging around 0.03–0.1 MPa is also possible. With hydrogen pressure greater than 0.03 MPa, the time required for hydrogen absorption into the RFeB material can be shortened, and with the hydrogen pressure within 0.1 MPa the hydrogen absorption is even more economical.

In addition, the gas that can be used in the process is not limited only to hydrogen gas, but it is also possible to use a mixture hydrogen gas with other inactive gases. In the latter case, the hydrogen gas pressure corresponds to the partial pressure of hydrogen gas. This is the same for the high-temperature hydrogenation and the first evacuation process.

② High-temperature hydrogenation process

The high-temperature hydrogenation process occurs after the low-temperature hydrogenation process, and the RFeB material is maintained under hydrogen gas atmosphere of 0.1–0.6 MPa and a temperature ranging between 750–850° C. This high-temperature hydrogenation process allows the structure of the RFeB material after the low-temperature hydrogenation process to decompose into three phases (α Fe phase, $RH_2$ phase, $Fe_2B$ phase). Then the structure transformation reaction can proceed gently with the regulated hydrogen gas pressure, because the RFeB material has already contained hydrogen during the previous low-temperature hydrogenation process.

The hydrogen gas pressure was maintained within 0.1–0.6 MPa because hydrogen gas pressure lower than 0.1 MPa, the reaction will decrease, leaving non-transformed structure and causing a decline in coercivity, whereas when the hydrogen gas pressure is increased beyond 0.6 MPa, the reaction rate will increase, causing a decline in anisotropy. The temperature of atmospheric hydrogen was maintained within 760–860° C. because at a temperature lower than 760° C., there will be incomplete decomposition of the three phases, causing a decline in the coercivity when it is made into an anisotropic magnet powder, whereas when the temperature is increased beyond 860° C., crystal particles will get larger and coarser, causing also a decline in the coercivity.

③ First evacuation process

In the first evacuation process, which occurs after the high-temperature hydrogenation process, the RFeB material is maintained under hydrogen gas atmosphere with a pressure ranging from 0.1–0.6 kPa at a temperature ranging from 750–850° C. Through this process, the hydrogen is removed from the $RH_2$ phase of the three abovementioned decomposed phases, leading to the polycrystalline recombined hydride (RfeBHx) in which each crystal has a crystal orientation aligned to the direction of the former $Fe_2B$ phase.

The hydrogen gas pressure was modulated within 0.1–0.6 MPa because with hydrogen gas pressure less than 0.1 MPa, Br will decrease and hydrogen will be completely eliminated, resulting in a loss of the oxidization-prevention effect, and when the hydrogen gas pressure is increased beyond 0.6 MPa, the reverse transformation will be insufficient, resulting in insufficient coercivity when it is made into an anisotropic magnet powder.

If the high-temperature hydrogenation process stated above and the first evacuation process are operated at the same temperature range, the processes can be switched conveniently just by changing hydrogen pressure.

④ Powdering process

In the powdering process, the RFeB material or the hydride of the RFeB material (RFeBHx) is crushed into a powder state yielding the RFeBHx powder.

In this crushing process, dry or wet type crushing equipment (jaw crusher, disc mill, ball mill, vibration mill, etc.) can be used.

The suitable average particle size for the RFeBHx powder is 50–200 μm. The powder whose particle size is less than 50 μm can not be obtained economically, on the other hand, the one whose particle size is greater than 200 μm can not be mixed uniformly with a diffusion powder. Here the average particle sizes can be determined by putting each powder through sieves of known size. The same method of size determination is used for the diffusion powders.

(3) Diffusion Powder

Diffusion powder is composed of a simple substance, an alloy, a compound or a hydride of one or more elements in an elemental group that includes Dy, Tb, Nd and Pr (R1 elements).

It is more desirable when the alloy, compound or the hydride of the alloy or compound includes one or more elements in an elemental group which consists of 3d and 4d transition elements (TM elements), wherein R1 elements and TM elements are diffused uniformly on the surface and inside of the RfeBHx powder in a diffusion treatment process.

The use of these diffusion powders, owing to the diffusion of R1 and TM elements, makes it possible to obtain a magnet with a greater coercivity and a lower loss of magnetization due to structure changes. While 3d and 4d transition elements correspond to the elements whose atomic numbers are from 2(Sc)—29(Cu) and 39(Y)—47(Ag) respectively, the group 8 elements Fe, Co and Ni are most efficient for the development of magnetic characteristics.

It is also possible to use a powder composed of a R1 elemental simple substance, an alloy, a compound or a hydride of one of the previous and a powder composed of a TM elemental simple substance, an alloy, a compound or a hydride of the previous that are independently prepared, mixed and then added. All of the compounds mentioned above may include metal compounds. The hydride may also include hydrogen in a solid solution state.

It is desirable if the diffusion powder is any of, dysprosium hydride powder, dysprosium-cobalt powder, neodymium hydride powder or neodymium-cobalt powder. Especially, the use of Dy or Nd as a R1 element brings about a high coercivity in the manufactured anisotropic magnet powder. In addition, the inclusion of Co as a TM element brings about an improvement of the Curie temperature of the manufactured anisotropic magnet powder.

The desired average particle size for the diffusion powder is 0.1–500 μm because while it is difficult to obtain diffusion powder whose average particle size less than 0.1 μm, the diffusion powder whose average particle size greater than 500 μm is difficult to uniformly blend with the abovementioned RFeBHx powder. The powder whose average particle size is around 1–50 μm is especially desirable to achieve uniform blending with the RFeBHx powder.

A diffusion powder can be obtained through ordinary hydrogen crushing or dry or wet type mechanical crushing (jaw crusher, disc mill, ball mill, vibration mill, jet mill, etc.) of an R1 elemental simple substance, an alloy, or a compound. Of these methods, hydrogen crushing is the most efficient. It is especially desirable when the diffusion powder is a hydride powder because the hydride is automatically obtained when crushing an R1 elemental simple substance, an alloy, or a compound.

(4) Blending Process

In the blending process the RFeBHx powder and a diffusion powder are mixed together.

For this blending process, a Henshall mixer, rocking mixer, ball mixer, or the like may be used.

To get a uniformed mixture of anisotropic magnet material and diffusion powder, crushing and classification of the mixture powder should be carried out as needed. This classification makes it easier to form the powder into a bonded magnet. And it is more desirable when the blending process is operated under oxidization-preventive atmosphere (for example, under inactive gas atmosphere or under vacuum), resulting in the further prevention of oxidization of the anisotropic magnet powder.

A favorable blending process is one in which 0.1–3.0 mol % of a diffusion powder is blended where the whole mixture powder is 100 mol %. Through an appropriate mixture ratio, an anisotropic magnet powder with a great coercivity, high degree of an anisotropy and a greatly improved loss of magnetization due to structure changes can be achieved.

(5) Diffusion Heat Treatment Process

In the diffusion heat treatment process, R1 elements and TM elements are diffused uniformly on the surface and inside of the RFeBHx powder, where the R1 elements work as an oxygen getter, preventing the anisotropic magnet powder or the magnet made of the powder from being oxidized. As a result, even when the magnet is used under high temperatures, deterioration of the performance of the magnet can be efficiently restrained or prevented.

The diffusion heat treatment process should be operated under oxidization-preventive atmosphere (for example, under vacuum) and at temperatures ranging from 400–900° C. When the temperature is lowered under 400° C. the diffusion rates of R1 and TM elements will decrease, whereas increasing temperature above 900° C. will cause the crystal particles to grow larger and rougher.

(6) Dehydrogenation Process (the Second Evacuation Process)

In the dehydrogenation process, which occurs after the diffusion heat treatment process, hydrogen is eliminated from the mixture powder. It is desirable when this process is operated at 750–850° C. under vacuum with pressure less than 1 Pa.

When the temperature is lowered under 750° C. the speed of elimination of remaining hydrogen will decrease, whereas increasing temperature beyond 850° C. will cause the crystal particles to grow larger and rougher. If the diffusion heat treatment process stated above and the dehydrogenation process are operated at the same range of temperature, a smooth transition can be made between the two processes. The pressure should be kept lower than 1 Pa because any greater pressure will result in remaining hydrogen, causing a decline in coercivity of the anisotropic magnet powder. Furthermore, a drastic cooling process is favorable following the dehydrogenation process to prevent crystal particle growth.

(7) Others

Making use of the anisotropic magnet powder mentioned above, a sintered magnet or a bonded magnet can be produced. In particular bonded magnets can be formed by addition of a thermo-setting resin, a thermo-plastic resin, a coupling agent or a lubricant to the anisotropic magnet powder, followed by mixing and blending, and finally by compression, extrusion or injection molding.

EXAMPLES OF THE APPLIED FORMS

More concrete explanations of the present invention will be given illustrating the applied forms of the invention as follows.

A precursory anisotropic magnet powder, an anisotropic magnet powder and a bonded magnet, which are examples of the applied forms of the invention (Sample No. 1-1~5-3), were manufactured as follows.

Example 1

Sample No. 1-1~1-4

(1) Manufacturing of the Precursory Anisotropic Magnet Powder

① RFeB material (sample material A)

Material alloy and material elements were measured to have composition A as shown in Table 1, then melted in high frequency melting furnace to manufacture 100 kg of ingot. In Table 1, compositions of each element are represented by at % where the total is 100 at %. The ingot alloy was heat-treated under Ar gas atmosphere at 1140° C. for 40 hours to unify its structure. Then, sample material (the RFeB material) was prepared by roughly crushing the unified ingot alloy via jaw crusher to an average particle size less than 10 mm.

② Low-temperature hydrogenation process 10 kg of the roughly crushed RFeB material was put into a low-temperature hydrogen treatment chamber in a hydrogen-treatment furnace, sealed and then maintained under low-temperature hydrogenation conditions, which are room temperature at 0.1 MPa for one hour (these conditions are common for all the other low-temperature hydrogenation processes). Here, the low-temperature hydrogen treatment chamber was evacuated before the introduction of hydrogen.

③ High-temperature hydrogenation process

Following the low-temperature hydrogenation process, the hydrogen-absorbed coarse powder is transferred from a low-temperature hydrogen treatment chamber to high-temperature hydrogen treatment chamber, without exposing it to the air, and then maintained under high-temperature hydrogenation conditions as shown in Table 2. The high-temperature hydrogen treatment room is equipped with hydrogen gas supply and evacuation parts (for the first and the second evacuation systems), a heater and a heat-compensation (heat balance) mechanism. By employing these, and adjusting the hydrogen gas atmosphere, the reaction rate of an ordered structure transformation was controlled.

④ The first evacuation process

Following the high-temperature hydrogenation process, hydrogen an other gasses were evacuated from the high-temperature hydrogen treatment chamber through the first evacuation system, then the powder was maintained under the evacuation conditions as shown in Table 2. By the use of a flow-rate-adjusting valve (mass flow meter) and the heater, the hydrogen atmosphere was regulated, and the reaction rate of the reverse structure transformation was controlled. Then, the material was transferred to a cooling chamber and cooled before being taken out.

Thus the hydride of sample material A was manufactured into the RFeBHx powder, which is the precursory anisotropic magnet powder.

The particle size of the obtained RFeBHx powder was about 30 μm~1 mm although a dependency on the materials used was seen.

(2) Manufacturing of an Anisotropic Magnet Powder

① Blending process

The diffusion powder shown in Table 2 (an average particle size: 5 μm) was added to the obtained RFeBHx powder, and blended under the conditions shown in the same table. The additive ratio of the diffusion powder in Table 2 represents the molar ratio of the diffusion powder to that of the sum of RFeBHx and the diffusion powders. Here ⌈Dy (Nd) 70Co30⌋ shown in Table 2 means that the diffusion powder is composed of 70 at % of Dy (Nd) and 30 at % of Co (and similarly for others shown).

The diffusion powder used here was obtained from an ingot manufactured through the same melting method as the RFeB material mentioned above.

② Diffusion heat-treatment process

After the blending process, a diffusion heat-treatment process was carried out under higher vacuum than $10^{-2}$ Pa and under the heat-treatment conditions shown in Table 2.

③ Dehydrogenation process (the second evacuation process)

Following the diffusion heat-treatment process, a further vacuum evacuation process was carried out. And with its final vacuum pressure of the degree of $10^{-4}$ Pa, the dehydrogenation process shown in Table 2 was conducted to sufficiently remove the remaining hydrogen from (Dy) $Nd_2Fe_{14}BHx$.

In addition, upon a drastic cooling of the achieved sample material after the dehydrogenation process, an anisotropic magnet powder was obtained.

Example 2

Sample No. 2-1

A sample material was prepared, manufacturing a strip that has the same composition as example 1 through a strip-casting method. To this sample material the same series of processes as described in example 1 were employed under the conditions shown in Table 2 to manufacture an anisotropic magnet powder.

Example 3

Sample No. 3-1~3-3

The RFeB material that has composition B in Table 1 was used as a sample material. An anisotropic magnet powder was manufactured based on the conditions shown in Table 2, in the same manner as that of example 1.

Example 4

Sample No. 4-1~4-3

The RFeB material that has composition C in Table 1 was used as a sample material. An anisotropic magnet powder was manufactured based on the conditions shown in Table 2, in the same manner as that of example 1. Because composition C includes Co, the Curie temperature increased, for example, to 350° C. when sample No. 4-1 was measured via VSM (Vibrating Sample Magnetometer).

For a comparison of the examples of the applied forms of the present invention, sample materials that correspond to each of comparative examples 1~5 were manufactured in the same manner as that of example 1 as follows. However, some of the treatment conditions are slightly different between example 1 and each of comparative examples.

Comparative Example 1

Sample No. C-1

An anisotropic magnet powder was manufactured by applying a low-temperature hydrogenation, a high-temperature hydrogenation, the first evacuation and a dehydrogenation process to the RFeB material sample material under the conditions shown in Table 3, however unlike the case of example 1, there was no addition and blending of a diffusion powder.

Comparative Example 1

Sample No. C-2

Unlike in example 1, the additive ratio of the diffusion powder was 4 mol % which exceeds 3 mol %. In all other ways, the same conditions as the case of example 1 were applied.

Comparative Example 3

Sample No. C-3

Compared to the example 1, atmospheric temperature for the diffusion heat-treatment process and the dehydrogenation process was lowered to 350° C. and 700° C. respectively.

Comparative Example 4

Sample No. C-4

Compared to example 1, atmospheric temperature for the diffusion heat-treatment process and the dehydrogenation process was increased to 950° C. and 900° C. respectively.

Comparative Example 5

Sample No. C-3

A different starting material from that of example 1 was used to manufacture an anisotropic magnet powder. The starting material (powder) was prepared by applying each of low-temperature hydrogenation, a high-temperature hydrogenation, the first evacuation and a dehydrogenation processes under the conditions shown in Table 3 to the RFeB material that has the same composition as that of example 1. In this case the starting material is not a powder with minute crystal particles that contains a hydride, but is a powder with minute crystal particles that contains no hydride. An anisotropic magnet powder was manufactured by adding the same diffusion powder as in example 1 (Sample No. 1-1) under the conditions shown in Table 3, and applying each of a blending and a diffusion heat-treatment process to this material powder.

Comparative Example 6

Sample No. C-6

Unlike the case of other examples, Dy was initially added to the RFeB material, and an ingot that has composition D in Table 1 was manufactured. And the powder obtained from the ingot was used as a precursory powder. Applying each of a high-temperature hydrogenation, the first evacuation and a dehydrogenation processes (the second evacuation process), an anisotropic magnet powder was manufactured.

Comparative Example 7

Sample No. C-7

Modifying composition D in comparative example 6 to composition E in Table 1, an anisotropic magnet powder was manufactured in the same manner that in comparative example 6.

(Bonded Magnet)

Bonded magnets were manufactured from anisotropic magnet powder obtained in each of the examples and comparative examples. Each of the anisotropic magnet powders were heat-formed under a magnetic field of 1200 kA/m into 7 mm square bonded magnets and then magnetized in a magnetic field of approximately 3600 kA/m (45 kOe). Solid epoxy resin of 3 mass % was added to each of the anisotropic magnet powders, and the combination was mixed.

(Characterization)

(1) Measurement

① Maximum energy products (BH)max, residual magnetic flux density Br, coercivity iHc, and degree of anisotropy Br/Bs for each of abovementioned examples and comparative examples at room temperature are indicated in Table 4. These magnetic characteristics were determined via VSM measurement for each kind of anisotropic magnet powder sieved to 75~105 μm. Here the inventors assumed Bs was equal to 1.6 T for the case of comparative example 1 where no diffusion powder was added, and assumed Bs was equal to 1.4 T for all other cases.

② The losses of magnetization due to structure changes for the bonded magnets made from each of the anisotropic magnet powders were determined. First, (the initial) magnetic flux (residual magnetic flux density) was measured upon about 3600 kA/m magnetization, then measured again upon remagnetization after keeping it at 120° C. in a high temperature bath for 1000 hours. Loss of magnetization due to structure changes were determined using both of the values.

Figure 3:
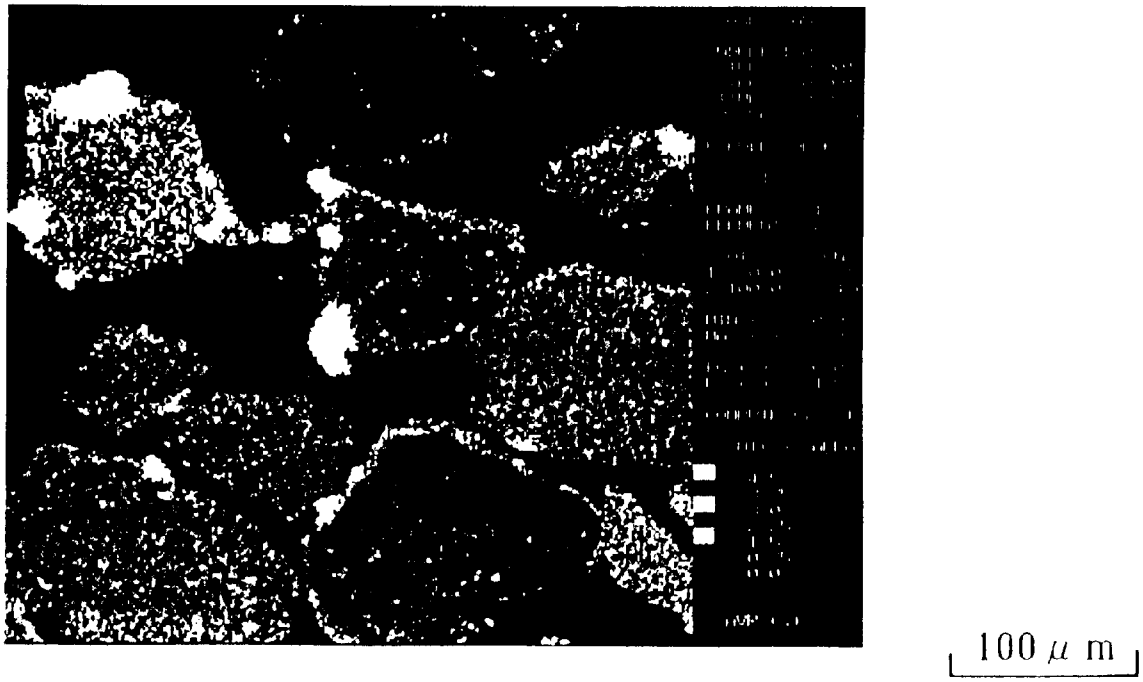
FIG. 3 The EPMA observed picture of an anisotropic magnet powder surface of one of the examples in the present invention.

The observed EPMA (Electron Probe Micro-Analyzer) image for the anisotropic magnet powder in an example 1 (Sample No. 1-1: Table 2) is shown in FIG. 3. In FIG. 3, Dy analysis results in the powder (the measured particle size is 75–106 μm) are indicated. The powder was embedded in resin and given a mirror-surface polishing before observation was carried out.

(2) Results

① As indicated in Table 4, the anisotropic magnet powder for any of the examples has a sufficiently high degree of anisotropy (or a residual magnetic flux density Br) as well as coercivity iHc. It is also shown that a bonded magnet made of any of the anisotropic magnet powder has a sufficiently low loss of magnetization due to structural changes.

② On the other hand, in comparative example 1, where no diffusion powder was been added, the anisotropic magnet powder did not achieve sufficient coercivity iHc and its loss of magnetization due to structural changes was quite large.

In a comparative example 2, although both the coercivity of the anisotropic magnet powder and the loss of magnetization due to structural changes of the bonded magnet were favorable, the degree of anisotropy decreased due to the excessive addition of diffusion powder, preventing the coercivity and the degree of anisotropy from being optimized at the same time. In comparative examples 2 and 3, unsuitable temperature conditions in the diffusion heat treatment and the dehydrogenation processes caused the powder to have a seriously poor coercivity and a high loss of magnetization due to structural changes when the powder was made into a bonded magnet. In comparative example 4, the coercivity in the anisotropic magnet powder was so poor that a bonded magnet was not manufactured from this powder.

In comparative example 5, where dehydrogenated powder was used as a starting material, oxidization was not inhibited sufficiently while blending the diffusion powder or during diffusion. For this reason, even in the same lot of anisotropic magnet powder, there was a significant difference in the magnetic characteristics between the powder located at the top and at the bottom positions. In Table 4, magnetic characteristics of the powder located at the top and at the bottom positions are indicated independently. The anisotropic magnet powder located at the bottom showed a knee on its magnetization curve, implying that partial oxidization had occurred. This decline in its coercivity might be attributed to oxygen gas absorption on the surface of the anisotropic magnet powder and reaction with the powder, oxidizing the rare earth elements. As a result, it turned out that the addition of a diffusion powder after the dehydrogenation process followed by blending and diffusion heat treatment cannot prevent oxidization, and that it is impossible to obtain an anisotropic magnet powder of constant quality with this method.

In comparative example 5, because Dy had been initially included in the RFeB material and a moderate HDDR treatment was operated under the conditions shown in Table 3, while its coercivity itself was satisfactory, the magnetic powder became isotropic causing a serious decline in its Br and (BH)max.

In comparative example 7, with a less amount of Dy additive compared to comparative example 6, its Br and (BH)max values were both satisfactory, but its coercivity was not large enough and its loss of magnetization due to structural changes was also extremely poor.

③ It can be seen from the EPMA image in FIG. 3 that Dy, which belongs to the R1 elements, is uniformly diffused on the surface and the inside of the anisotropic magnet powder.

An explanation about the case where the anisotropic magnet powder was manufactured using the machine displayed in FIG. 2 (example 5) will be given below.

Example 5

Sample No. 2-1

Using a sample material made from the strip described in example 2, employing the same processes as in example 1 under the conditions shown in Table 2, a precursory anisotropic magnet powder (RFeBHx powder) was manufactured. Then the RFeBHx powder was recovered in a hopper of the equipment displayed in FIG. 2 (rotary retort furnace equipment) and each of a blending process, a diffusion heat-treatment process and a dehydrogenation process was performed in turn under the conditions shown in Table 2.

Figure 2:
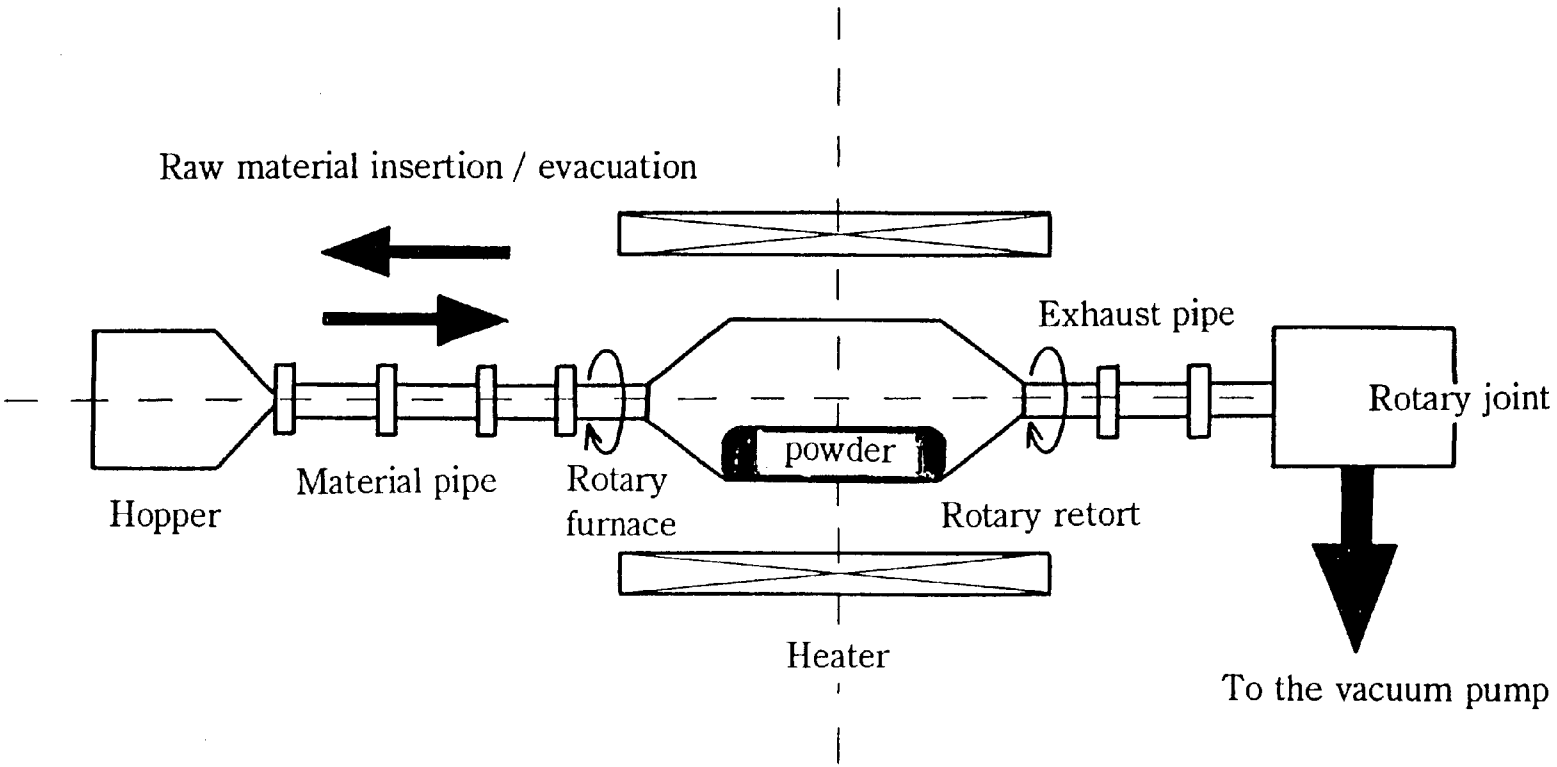
FIG. 2 Rotary retort furnace equipment that can perform a blending process of a diffusion powder, a diffusion heat-treatment process and a dehydrogenation process as serial processes is schematically displayed.

The rotary retort furnace equipment consists of a hopper from which a material powder is put and recovered (as shown in FIG. 2), a rotary retort with one end connected to the hopper and that can rotate via a motor (not shown in figure), a rotary joint connected to a vacuum pump, which supports the other end of the rotary retort, and a heater that heats the rotary retort. The rotary retort is equipped in its center with a rotary furnace that can hold a material powder and it consists of a material pipe that connects one end of the rotating furnace with the hopper and an exhaust pipe that connects the other end of the rotating furnace with the rotary joint. All of these can rotate as one where insertion and evacuation of the material powder are performed through the material pipe and evacuation in the rotary furnace is performed by a vacuum pump through the exhaust pipe. Although it is not shown in figure, a driving motor of the rotary retort, a heater and a vacuum pump are available for each process under fixed conditions controlled by equipment that consists of computers and the like.

TABLE 1

| The RFeB | Compositions (at %) | | | | | | | |
|---|---|---|---|---|---|---|---|---|
| material | Nd | Ga | Nb | B | Co | Dy | Fe | Remarks |
| A | 12.5 | 0.3 | 0.2 | 6.4 | — | — | The rest | Example 1 (ingot) Example 2, 5 (strip) Comparative example 1~5 (ingot) |
| B | 12.5 | 0.5 | 0.1 | 6.4 | — | — | The rest | Example 3 (ingot) |
| C | 12.5 | 0.3 | 0.2 | 6.4 | 5.0 | — | The rest | Example 4 (ingot) |
| D | 11.5 | 0.3 | 0.2 | 6.4 | — | 1.0 | The rest | Comparative example 6 (ingot) |
| E | 12.1 | 0.3 | 0.2 | 6.4 | — | 0.4 | The rest | Comparative example 7 (ingot) |

TABLE 2

| | | | | High-temperature hydrogenation conditions | | | The first evacuation conditions | | | Blending conditions | | | Diffusion heat-treatment conditions | | | Dehydrogenation conditions (The second evacuation conditions) | | |
|---|---|---|---|---|---|---|---|---|---|---|---|---|---|---|---|---|---|---|
| | | Sample No. | Diffusion powder (mol %) | Temperature (° C.) | Pressure (MPa) | Time (hour) | Temperature (° C.) | Pressure (kPa) | Time (minute) | Temperature (° C.) | Pressure (MPa) | Time (hour) | Temperature (° C.) | Degree of vacuum (Pa) | Time (hour) | Temperature (° C.) | Degree of vacuum (Pa) | Time (hour) |
| Examples | 1 | 1-1 | $DyH_2$ 1.0 | 820 | 0.03 | 8 | 820 | 1 | 240 | Room temp. | Ar gas 0.1 | 1 | 800 | $\sim 10^{-4}$ | 0.5 | 800 | $\sim 10^{-4}$ | 0.5 |
| | | 1-2 | $DyH_2$ 0.1 | ↑ | ↑ | ↑ | ↑ | ↑ | ↑ | ↑ | ↑ | ↑ | ↑ | ↑ | ↑ | ↑ | ↑ | ↑ |
| | | 1-3 | Nd70Co30 1.0 | ↑ | ↑ | ↑ | ↑ | ↑ | ↑ | ↑ | ↑ | ↑ | ↑ | ↑ | ↑ | ↑ | ↑ | ↑ |
| | | 1-4 | Dy70Co30 1.0 | ↑ | ↑ | ↑ | ↑ | ↑ | ↑ | ↑ | ↑ | ↑ | ↑ | ↑ | ↑ | ↑ | ↑ | ↑ |
| | 2 | 2-1 | $DyH_2$ 0.5 | ↑ | ↑ | ↑ | ↑ | ↑ | ↑ | ↑ | ↑ | ↑ | ↑ | ↑ | ↑ | ↑ | ↑ | ↑ |
| | 3 | 3-1 | $DyH_2$ 1.0 | 825 | 0.03 | ↑ | 825 | ↑ | ↑ | ↑ | ↑ | ↑ | ↑ | ↑ | ↑ | ↑ | ↑ | ↑ |
| | | 3-2 | $NdH_2$ 1.0 | 825 | 0.03 | ↑ | 825 | ↑ | ↑ | ↑ | ↑ | ↑ | ↑ | ↑ | 0.5 | ↑ | ↑ | ↑ |
| | | 3-3 | Dy70Co30 1.0 | 820 | 0.035 | ↑ | 820 | 2 | ↑ | 200 | ↑ | ↑ | ↑ | ↑ | ↑ | ↑ | ↑ | ↑ |
| | 4 | 4-1 | $DyH_2$ 1.0 | 820 | 0.04 | ↑ | 820 | 1 | ↑ | ↑ | ↑ | ↑ | ↑ | ↑ | 1 | ↑ | ↑ | 1 |
| | | 4-2 | Nd70Co30 1.0 | 800 | 0.04 | ↑ | 800 | 3 | ↑ | Room temp. | ↑ | ↑ | ↑ | ↑ | 0.5 | ↑ | ↑ | ↑ |
| | | 4-3 | $NdH_2$ 1.0 | 810 | 0.045 | ↑ | 810 | 1 | ↑ | 150 | ↑ | ↑ | ↑ | ↑ | ↑ | ↑ | ↑ | 0.5 |
| | 5 | 5-1 | $DyH_2$ 1.0 | 830 | 0.035 | ↑ | 830 | 1 | ↑ | ↑ | ↑ | ↑ | ↑ | ↑ | ↑ | ↑ | ↑ | ↑ |

Low-temperature hydrogenation process: room temperature at 0.1 MPa for 1

TABLE 3

| | | | | High-temperature hydrogenation conditions | | | The first evacuation conditions | | | Blending conditions | | | Diffusion heat treatment conditions | | | Dehydrogenation conditions (The second evacuation conditions) | | |
|---|---|---|---|---|---|---|---|---|---|---|---|---|---|---|---|---|---|---|
| | | Sample material No. | Diffusion powder (mol %) | Temperature (° C.) | Pressure (MPa) | Time (hour) | Temperature (° C.) | Pressure (kPa) | Time (minute) | Temperature (° C.) | Pressure (MPa) | Time (hour) | Temperature (° C.) | Degree of vacuum (Pa) | Time (hour) | Temperature (° C.) | Degree of vacuum (Pa) | Time (hour) |
| Comparative examples | 1 | C-1 | — | 820 | 0.03 | 8 | 820 | 1 | 240 | — | — | — | 800 | $\sim 10^{-4}$ | 0.5 | 800 | $\sim 10^{-4}$ | 0.5 |
| | 2 | C-2 | $DyH_2$ 4.0 | ↑ | ↑ | ↑ | ↑ | ↑ | ↑ | Room temp. | Ar gas 0.1 | ↑ | ↑ | ↑ | ↑ | ↑ | ↑ | ↑ |
| | 3 | C-3 | $DyH_2$ 1.0 | ↑ | ↑ | ↑ | ↑ | ↑ | ↑ | ↑ | ↑ | ↑ | 350 | ↑ | ↑ | 700 | ↑ | ↑ |
| | 4 | C-4 | $DyH_2$ 1.0 | ↑ | ↑ | ↑ | ↑ | ↑ | ↑ | ↑ | ↑ | ↑ | 950 | ↑ | ↑ | 900 | ↑ | ↑ |
| | 5 | C-5 | $DyH_2$ 1.0 | ↑ | ↑ | ↑ | ↑ | ↑ | ↑ | ↑ | ↑ | ↑ | 800 | ↑ | ↑ | 800 | ↑ | ↑ |
| | 6 | C-6 | — | 860 | 0.08 | ↑ | 860 | ↑ | ↑ | — | — | — | — | — | — | 800 | ↑ | 1.0 |
| | 7 | C-7 | — | ↑ | 0.05 | ↑ | ↑ | ↑ | ↑ | — | — | — | — | — | — | ↑ | ↑ | ↑ |

A low-temperature hydrogenation process:room temperature at 0.1 MPa for 1

TABLE 4

| | | Sample material No. | Anisotropic magnet powder: Mximum energy product (BH)max (kJ/m³) | Residual magnetic flux density Br (T) | Coercivity iHC (kA/m) | Degree of anisotropy Br/Bs | Bonded magnet Degree of permanent demagnetization (%) | Remarks |
|---|---|---|---|---|---|---|---|---|
| Examples | 1 | 1-1 | 258 | 1.16 | 1527 | 0.83 | 7 | |
| | | 1-2 | 309 | 1.3 | 1320 | 0.92 | 9 | |
| | | 1-3 | 288 | 1.27 | 1114 | 0.91 | 12 | |
| | | 1-4 | 270 | 1.23 | 1416 | 0.87 | 9 | |
| | 2 | 2-1 | 282 | 1.24 | 1209 | 0.88 | 10 | |
| | 3 | 3-1 | 255 | 1.18 | 1511 | 0.84 | 8 | |
| | | 3-2 | 301 | 1.32 | 1090 | 0.82 | 10 | |
| | | 3-3 | 272 | 1.18 | 1479 | 0.84 | 8.2 | |
| | 4 | 4-1 | 278 | 1.22 | 1488 | 0.87 | 7.6 | |
| | | 4-2 | 307 | 1.34 | 1106 | 0.84 | 9.2 | |
| | | 4-3 | 271 | 1.22 | 1448 | 0.87 | 8.1 | |
| | 5 | 5-1 | 246 | 1.15 | 1511 | 0.82 | 10 | |
| Comparative examples | 1 | C-1 | 298 | 1.32 | 986 | 0.82 | 18 | |
| | 2 | C-2 | 159 | 0.9 | 1591 | 0.64 | 6 | |
| | 3 | C-3 | 199 | 1.12 | 398 | 0.8 | 20 | |
| | 4 | C-4 | 95 | 1.02 | 103 | 0.73 | — | |
| | 5 | C-5 | 239/207 | 1.13/1.04 | 1488/1138 | 0.81/0.74 | 11/20 | Uppper/ Lower |
| | 6 | C-6 | 95 | 0.74 | 1432 | 0.5 | — | |
| | 7 | C-7 | 239 | 1.15 | 1273 | 0.82 | 18 | |

What is claimed is:

1. A method of manufacturing an anisotropic magnet powder, comprising blending RFeBHx powder comprising at least one rare earth R element seleted from the group consisting of yttrium, boron and iron, with a diffusion powder comprising at least one R1 element selected from the group consisting of dysprosium, terbium, neodymium and praseodymium;

diffusion heat-treating, wherein the at least one R1element is diffused uniformly on the surface and inside of the RFeBHx powder; and dehydrogenating, wherein hydrogen is removed from the mixture of the powder after the diffusion heat-treatment process.

2. The method according to claim 1 wherein the diffusion powder further contains one or more elements selected from the group consisting of 3d and 4d transition elements (TM) and wherein the at least one R1 element and the TM elements are diffused uniformly on the surface and inside of the RFeBHx powder by diffusion heat-treating.

3. The method accordingly to claim 1 further comprising applying a low-temperature hydrogenation process in which the above-mentioned RFeB material is maintained under hydrogen gas atmosphere at a temperature lower than 600° C., high-temperature hydrogenating, wherein the RFeB material is maintained under hydrogen gas atmosphere with hydrogen gas pressure of from 0.1 to 0.6 MPa at a temperature of from 750 to 850° C. and a first evacuation process in which the RFeB material is maintained under hydrogen gas atmosphere with hydrogen pressure of from 0.1 to 6.0 MPa at a temperature of from 750 to 850° C.

4. The method according to claim 1 wherein the diffusion powder is at least one member selected from the group consisting of a dysprosium hydride powder, a dysprosium-cobalt powder, a neodymium hydride powder, and a neodymium-cobalt powder.

5. The method according to claim 1 wherein from 0.1 to 3.0 mol % of a diffusion powder is blended with the entire mixture powder of 100 mol % during blending.

6. The method according to claim 1 wherein the diffusion heat-treating is operated under oxidization-preventive atmosphere at a temperature of from 400 to 900° C.

7. The method according to claim 1 wherein the dehydrogenating is operated at a temperature of from 750 to 850° C. under vacuum with a pressure of less than 1 Pa.

8. The method according to claim 1 wherein the RFeB material comprises iron, from 11 to 15 at % of R, and from 5.5 to 8 at % of B.

9. The method according to claim 1 wherein R is neodymium.

10. The method according to claim 1 wherein the RFeB material comprises at least one member selected from the group consisting of gallium and niobium.

11. The method according to claim 2 wherein the diffusion powder is at least one member selected from the group consisting of a dysprosium hydride powder, a dysprosium-cobalt powder, a neodymium hydride powder, and a neodymium-cobalt powder.

12. The method according to claim 2 wherein the diffusion heat-treating is operated under oxidization-preventive atmosphere at a temperature of from 400 to 900 ° C.

13. The method according to claim 1 wherein the diffusion powder comprises at least one R1 element, an alloy comprising at least one R1 element, a compound comprising at least one R1 element, or a hydride comprising at least one R1 element.

* * * * *

UNITED STATES PATENT AND TRADEMARK OFFICE

CERTIFICATE OF CORRECTION

PATENT NO. : 6,709,533 B1
DATED : March 23, 2004
INVENTOR(S) : Yoshinobu Honkura et al.

It is certified that error appears in the above-identified patent and that said Letters Patent is hereby corrected as shown below:

Column 19,
Lines 33-34, "consisting of yttrium," should read -- consisting of the rare earth elements and yttrium, --

Signed and Sealed this

Second Day of November, 2004

JON W. DUDAS
*Director of the United States Patent and Trademark Office*